US007307586B2

(12) United States Patent
Peshlov et al.

(10) Patent No.: US 7,307,586 B2
(45) Date of Patent: Dec. 11, 2007

(54) FLAT MICROWAVE ANTENNA

(75) Inventors: Vesselin Nikolov Peshlov, Pazardjik (BG); Rossen Nikolov Traykov, Lom (BG)

(73) Assignee: Raysat Cyprus Limited, Nicosia (CY)

( * ) Notice: Subject to any disclaimer, the term of this patent is extended or adjusted under 35 U.S.C. 154(b) by 0 days.

(21) Appl. No.: 10/563,622

(22) PCT Filed: Jul. 6, 2004

(86) PCT No.: PCT/BG2004/000011

§ 371 (c)(1),
(2), (4) Date: Jan. 6, 2006

(87) PCT Pub. No.: WO2005/004284

PCT Pub. Date: Jan. 13, 2005

(65) Prior Publication Data

US 2006/0152414 A1 Jul. 13, 2006

(30) Foreign Application Priority Data

Jul. 7, 2003 (BG) ..... 107973

(51) Int. Cl.
*H01Q 1/38* (2006.01)

(52) U.S. Cl. ..... 343/700 MS; 343/700 MS; 343/770; 343/853

(58) Field of Classification Search ..... 343/770, 343/853, 700 MS
See application file for complete search history.

(56) References Cited

U.S. PATENT DOCUMENTS

| | | | | |
|---|---|---|---|---|
| 5,734,354 | A | 3/1998 | Twelves | |
| 5,872,545 | A | 2/1999 | Rammos | |
| 6,028,562 | A * | 2/2000 | Guler et al. | 343/771 |
| 6,184,832 | B1 | 2/2001 | Zagroonick et al. | |
| 6,229,484 | B1 * | 5/2001 | Sagisaka | 343/700 MS |
| 6,297,774 | B1 | 10/2001 | Chung | |
| 6,388,619 | B2 * | 5/2002 | Perrott et al. | 343/700 MS |
| 6,456,241 | B1 * | 9/2002 | Rothe et al. | 343/700 MS |
| 7,123,193 | B2 * | 10/2006 | Velve | 343/700 MS |

FOREIGN PATENT DOCUMENTS

EP 0 252 779 A 1/1988

* cited by examiner

*Primary Examiner*—Trinh Dinh
*Assistant Examiner*—Dieu Hien T Duong
(74) *Attorney, Agent, or Firm*—Banner & Witcoff, Ltd.

(57) ABSTRACT

An antenna has stacked grounded metal plates with openings (1, 2, 3) and antenna layers (4, 5) with feed lines (4B, 5B), situated between grounded metal plates. The openings in the grounded metal plates are arranged as matrix of columns and rows. The ends of the feed lines (4D, 5D) are aligned with the plate's openings (1A) in order to form radiating elements. The plate (7) is placed below the bottom grounded plate (3). The three-plate stack is arranged as two antenna packages (Ap1 and Ap2). These packages include also a layer (8) comprising active devises for initial amplification of the received signal, which are connected to the groups of radiating elements (4D, 5D, 1A) through coaxial transitions (13). As well as a combiner block (9) is connected to the active layer (8). The antenna layers (4, 5) are arranged in subarrays and the antenna output is connected by a transition (12) to a standard twin Low Noise Block.

11 Claims, 6 Drawing Sheets

FLAT MICROWAVE ANTENNA

This application is a National Stage application of co-pending PCT application No. PCT/BG2004/1000011 filed 6 Jul. 2004, which was published in the English language under PCT Article 21(2) on 13 Jan. 2005, and claims the benefit of the Bulgarian Application No. 107973 filed 7 Jul. 2003, these applications are incorporated herein by reference in their entireties.

FIELD OF THE INVENTION

The present invention refers to a flat microwave antenna applicable to mobile communication systems for satellite signal reception from satellites arranged on geostationary orbit.

BACKGROUND OF THE INVENTION

U.S. Pat. No. 5,872,545 discloses a multi-plate stack type microwave antenna, comprising a set of slot radiating elements arranged as a matrix of columns and rows. The basic antenna package consists of three plates with openings and two plates comprising feed lines that allow the forming of two receiving beams having a specified angle between them. Antenna includes also at least another two plates comprising feed lines so that each one of the beams to be able to support two polarizations. These feed lines could be arranged as microstrip lines, parallel waveguides, twin-lead transmission lines or combination between them. These lines are arranged in pairs rotated at 90° angle to each other. The disclosed antenna could be used to receive signals from two separate geostationary satellites.

The disadvantage of the antenna described above is its considerable height, preventing its application on mobile platforms, while any attempt for its height reduction will lead to unacceptable degradation of the antenna performance.

TECHNICAL DESCRIPTION OF THE INVENTION

The objective of the invention is to provide flat microwave antenna with reduced height, while keeping good antenna performance.

In addition, feed lines insertion loss reduction and equalization of the signals for different polarizations should be achieved The above mentioned objectives are met by the proposed flat microwave antenna, comprising stacked grounded metal plates with openings and antenna feed layers situated between them wherein the openings are arranged as a matrix of columns and rows and the feed lines are matched in pairs with the corresponding openings, forming that way antenna radiating elements. A metal screen is utilized at the bottom, below the grounded metal plates. In accordance with an embodiment of the invention the stacked plates are arranged as two separate antenna packages, each one of them containing two orthogonal polarizations, feeds and elements. The antenna contains also a layer with active devices for initial amplification of the received signal, connected through coaxial transitions with the feed of the radiation elements as well as a combining block, connected correspondingly to the active layer. The whole array antenna is subdivided into several sub-arrays. The signal from the antenna elements arranged in sub-arrays is thoroughly combined and then connected to the layer comprising active components (8) by means of coaxial transitions. An RF combining block accomplishes the final combining of the two halves of the antenna and the antenna output is connected to a standard twin Low Noise Block (LNB).

By one embodiment insulating sheets from low loss dielectric material with proper thickness are placed between the grounded metal plates By another embodiment antenna layers are separated into sixteen sub-arrays, wherein each two of them are identical halves of the one antenna quarter. In this embodiment it is convenient antenna layers for each one of the antenna quarters to be rotated at 90° with respect to each other.

It is useful to use a metal sheet with thickness between 0.1-0.3 mm for the central conductor of the strip line, processed by an appropriate known technology for etching in order to form the feed lines.

In this embodiment supporting frames and mechanical connections could be accomplished as RF (radio frequency) decoupling circuits.

By another embodiment the radiating apertures are arranged in octagonal shape, having four long parallel sides and four short sides connected at the corners.

By another embodiment the upper metal plate with openings is made from a metal sheet much thicker than the other plates By another embodiment the transition between the antenna output and the LNB is performed using asymmetrically shaped feed lines' ends in order to excite properly cylindrical waveguide at the LNB input, wherein the transition of microstrip lines to the waveguide is accomplished by means of a short piece of grounded coplanar line.

The advantages of the flat microwave antenna according to the present invention are connected with the possibility to achieve a low height of the antenna and to facilitate its installation directly on the roofs of the different moving platforms (like cars, buses, trucks, sport utility vehicles, trains etc.), keeping at the same time aerodynamic properties of the vehicle almost unchanged. The low profile of the antenna is achieved without degradation of the antenna performance and especially antenna's figure of merit.

Due to the specific arrangement of the radiating apertures and the construction of feed lines, a significant insertion loss reduction in antenna feed layers is achieved. Dividing the antenna into sub-arrays and changing the position of the layers dedicated to different polarizations allow achieving of the signal amplitudes' equalization for two different polarizations at the antenna output.

EXAMPLES OF SPECIFIC IMPLEMENTATION

The example refers to the preferred application, namely planar active antenna 1-13 (shown in FIG. 1) as a part of a system for in-motion signal reception from satellite on geo-stationary orbit. Hence, the preferred shape of the antenna is rectangular in order to decrease the overall height of the whole system.

The antenna consists of a high number of radiating elements arranged in rows and columns at appropriate distance and forming antenna array.

The distance between adjacent elements is about 0.7 to 0.9 wavelengths in free space for the antenna frequency band of operation, e.g. Ku-band (10.7-12.75 GHz).

Figure 1:
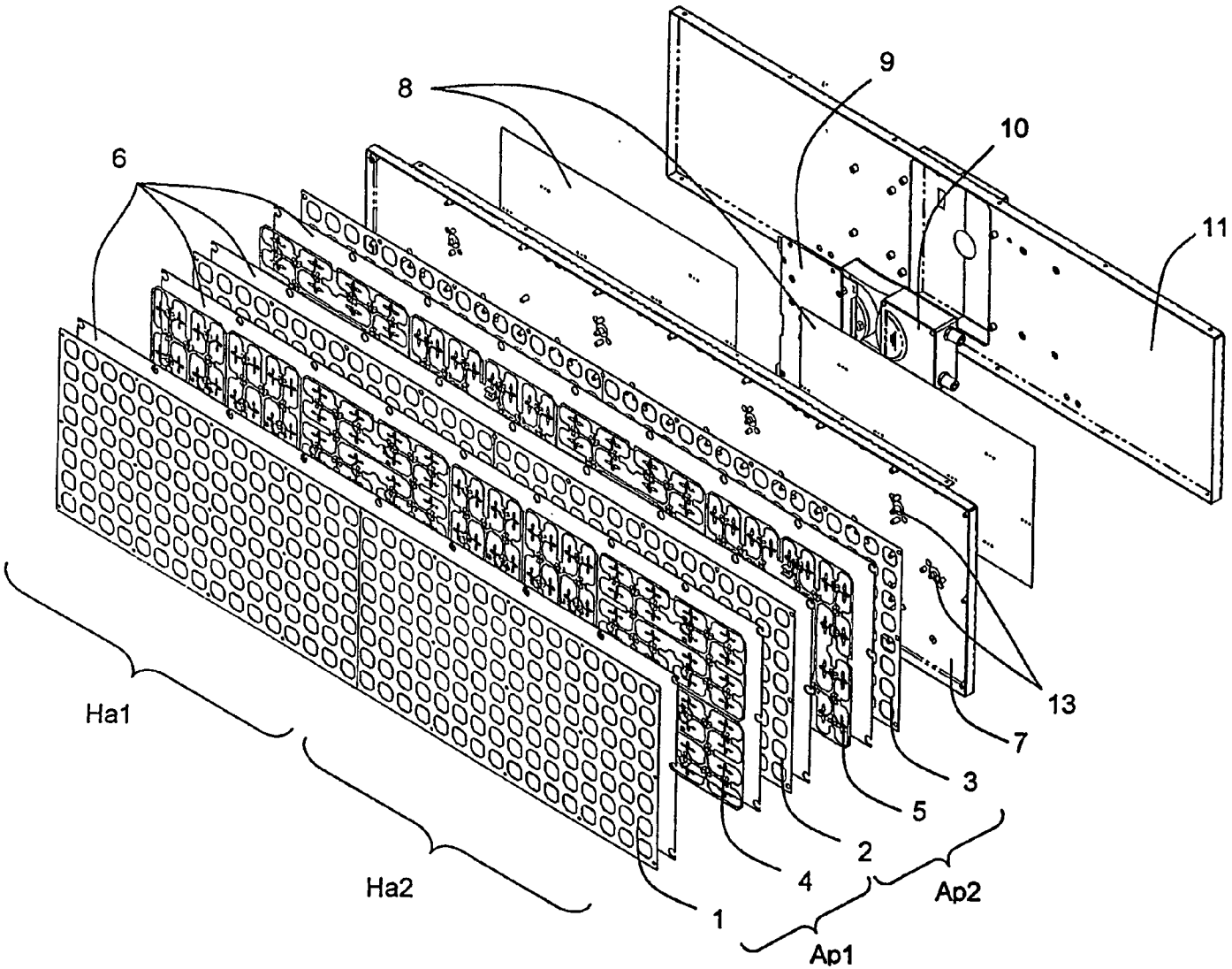
FIG. 1 is an exploded view of the antenna construction in accordance to an embodiment of the present invention.
Figure 2:
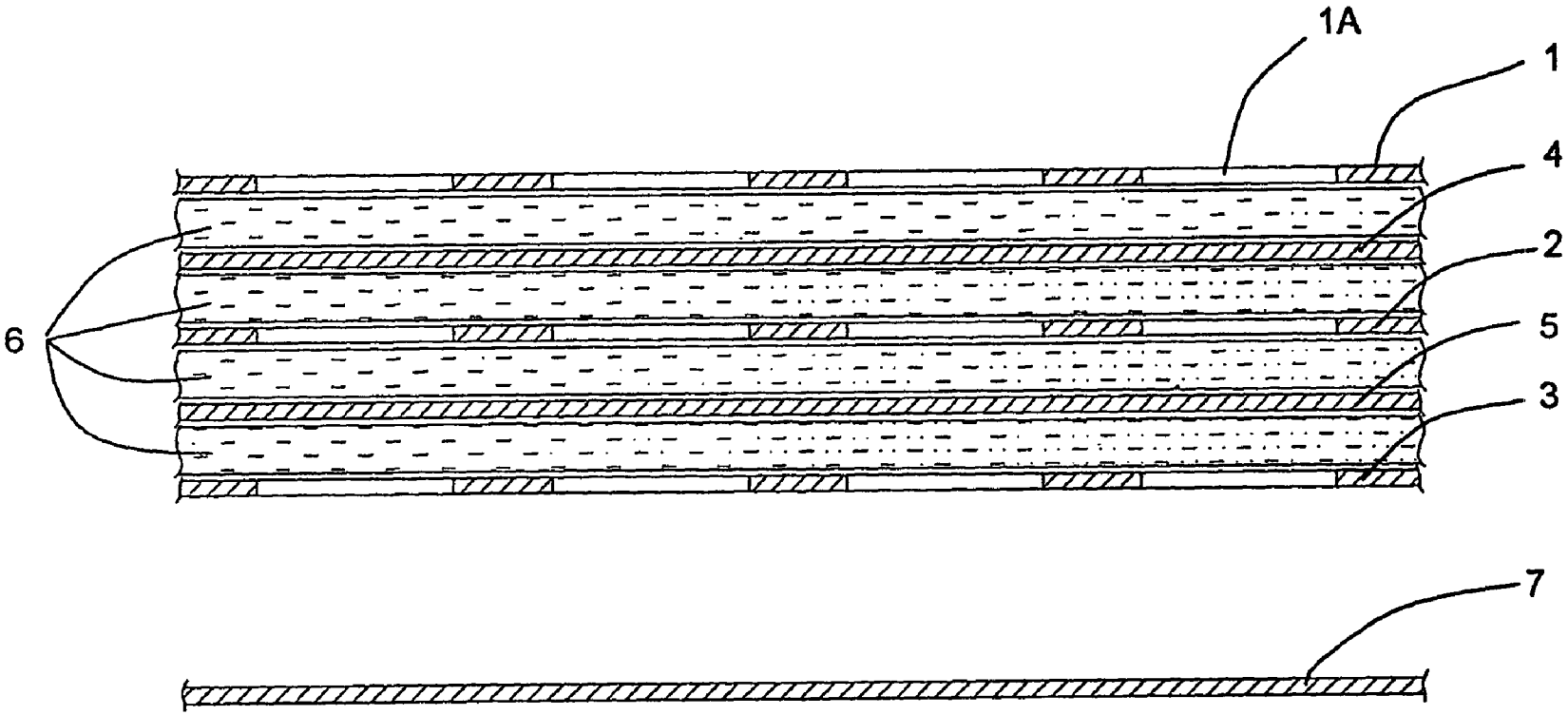
FIG. 2 is a fragmentary sectioned view of the radiating elements and feed lines of the antenna in FIG. 1
Figure 3:
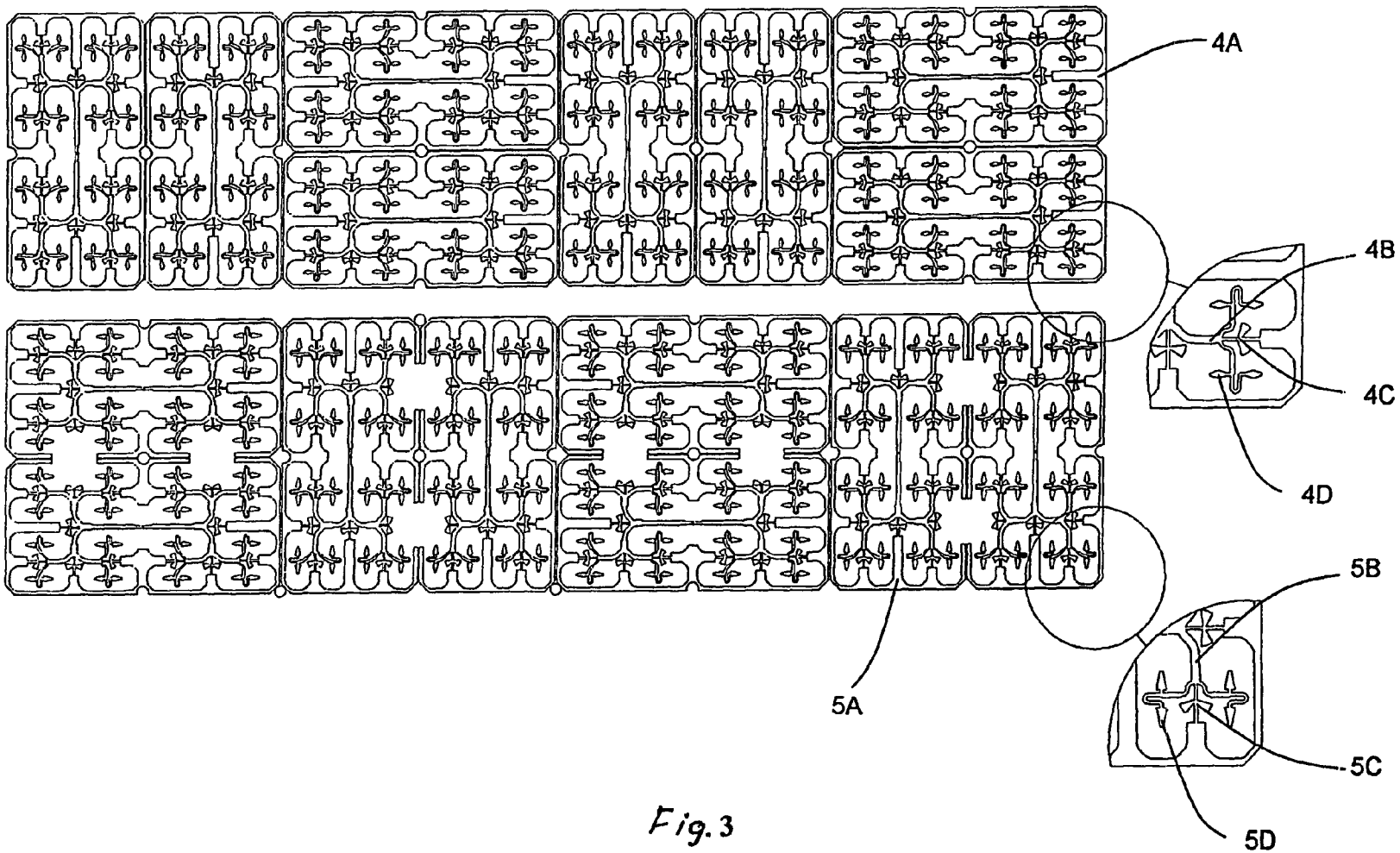
FIG. 3 illustrates the arrangement of the feed lines made of a thin metal sheet in accordance with an embodiment of the invention.
Figure 4:
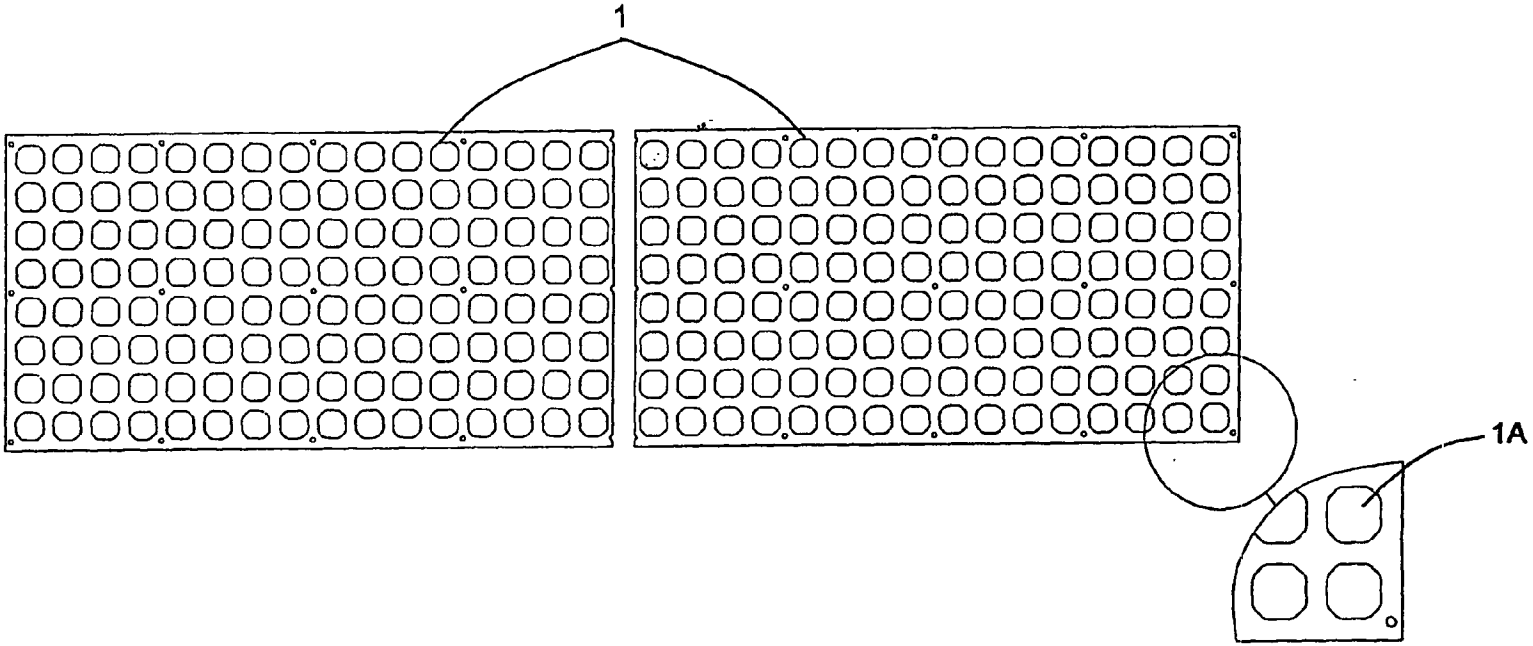
FIG. 4 illustrates two halves of the metal plates with openings (radiating apertures) in accordance with an embodiment of the invention.
Figure 5:
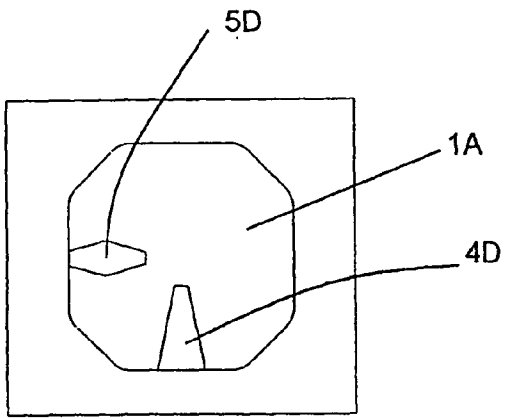
FIG. 5 illustrates the excitation probes and radiating aperture alignment in accordance with an embodiment of the invention.

The antenna shown on FIG. 1 consists of two separate packages Ap1 and Ap2 for two orthogonal polarizations, layer 8 with low-noise amplifiers used for pre-amplification of the received signal, and block 9 for signal combining. As shown in FIG. 2 the antenna layers 4 and 5 are placed between three grounded metal plates 1, 2 and 3 with plurality of openings 1A, which form radiating apertures. Another solid metal plate 7 is situated below the three-plate stack with apertures and serves as a shielding for radiating elements. Antenna layers 4 and 5 are arranged on two different levels (upper and lower) and are put together with the grounded metal plates 1, 2 and 3 in such a way that the ends of the lines 4D and 5D (see FIG. 3), which serve as an excitation probes of the radiating elements, are able to match in pairs with radiating apertures 1A. The described combination of radiating aperture 1A and feed lines 4D and 5D is in fact the radiating (antenna) element of the antenna array. The signals received from the antenna elements are combined initially on a sub-array level by antenna layers 4 and 5. The selected number of the antenna sub-arrays is eight for each polarization (a total of sixteen for the whole antenna) and it may vary depending on the size and specific implementation of the antenna. The signals combined from the elements in corresponding sub-arrays are passed through the coaxial transition 13 to the layer 8, which contains active devices (low-noise amplifiers 8B shown in FIG. 5). Thus, by grouping the radiating elements in sub-arrays on antenna layers 4 and 5 followed by amplification of the corporate signals on layer 8 an optimal figure of merit of the receiving antenna is achieved. Type of feed line used in the antenna layers is stripline in order to reduce significantly the insertion losses in comparison to a similar implementation, for instance, based on suspended substrate line. Central conductor of the stripline 4B and 5B shown in FIG. 3 is produced from metal sheet with small thickness (0.1 to 0.3 mm) and with high conductivity of the used metal. The technology for production may be chemical etching, laser cutting or other suitable technological process. Two insulating layers 6 of low-loss dielectric material with thickness of 1 mm are used to support the antenna layers 4 and 5 between the metal plates 1, 2 and 3 comprising radiating apertures. Feed lines 4B and 5B and passive combining devices used in the antenna layers are designed to have minimal length and suitable shape in order to fit best in the spacing between radiating apertures 1A. Shape of the apertures, as it is shown in FIG. 4, is basically octagon with non-equal side lengths. Such a shape of the radiating aperture allows minimizing the length of the feed lines without any degradation of the antenna element performance. This approach helps to decrease the signal loss in the antenna layers 4 and 5 prior to the first amplification and contributes to a better figure of merit of the antenna. Metal frames formed from the same metal sheet are used in order to ensure additional mechanical support for the stripline central conductor and to provide better manufacturability and easy assembling. These frames 4A (FIG. 3) are placed around and between feed lines and are physically connected to them by special elements for mechanical support 4C. These elements consist of narrow metal lines and stubs having appropriate shape and size. They connect stripline feed lines and combining devices with the supporting frames, which may be electrically grounded. The elements for mechanical support are implemented as RF (radio frequency) decoupling circuits (chokes), so as not to decrease the performance and disturb the functionality of the feed lines and combining devices for the received signal.

Excitation probes 4D and 5D of the antenna layers 4 and 5 shown in FIG. 3 are cooperated and electromagnetically coupled to the openings in the three-plate stack, thereby forming the antenna elements. They have appropriate shape in order to ensure proper matching and minimal losses of the received signal, and to obtain good decoupling between the two orthogonal polarizations in the frequency band of operation. As already mentioned, the antenna layers 4 and 5 are divided into sixteen sub-arrays and each two of them are identical halves of the one antenna quarter (see FIG. 3). Feed lines of each sub-array are mechanically held together by the frames 4A and 5A forming thereby a common feed lines structure. Each polarization in the antenna is obtained separately after signal combining on upper 4 and lower 5 antenna layers. Each two adjacent quarters of the antenna layers are rotated at 90 degrees angle to each other. Therefore, the corresponding antenna beam for two different polarizations is a result of the combination between each two adjacent quarters from different antenna layers 4 and 5. Hence, this combining approach assures amplitude equalization of the two polarizations signals, resulting from combining of the energy from the upper 4 antenna layer with the energy from the lower 5 antenna layer. On the other hand, the initially existing difference in the received signals for vertical and horizontal polarization is due to:

- Shape of the antenna panel is rectangular having big difference in the dimensions of the two sides (in the case of the described antenna shown in FIG. 1 the ratio is 4:1). The conditions for transmission of asymmetric transverse electromagnetic waves are beneficial in the direction of the longer side and their energy is in favour of the antenna polarisation in this direction (horizontal polarization).
- Difference in the levels on which antenna layers 4 and 5 are situated leads to corresponding difference in the element gain for each one of the antenna package levels—upper Ap1 and lower Ap2.

Rotation of each two adjacent quarters in the antenna configuration is accomplished in a way that provides opposite orientation of the electrical field vectors for neighbouring quarters (see FIG. 3). This approach allows decreasing side lobes in the antenna radiation pattern, which are due to the inclined maximum of the radiating element pattern. Because of the specific for the configuration asymmetric position (FIG. 5) of the feed lines 4D and 5D toward the radiating aperture 1A, the radiating element basically has inclined radiation pattern. By means of the described antenna layers arrangement, better antenna performance is obtained for circular polarization, achieving higher values for directivity and figure of merit.

Figure 6:
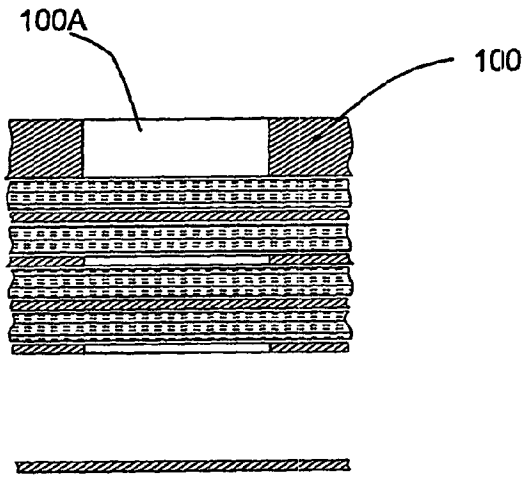
FIG. 6 is a fragmentary sectioned view of the radiating elements and feed lines of the antenna in FIG. 1 of another embodiment of the invention, comprising thicker upper metal plate.

Reducing the asymmetry of the element radiation pattern and, hence, further decreasing of the side lobes' level is achieved by replacement of the upper metal grid 1, which has radiating apertures 1A, by a much thicker metal sheet 100 having the same apertures 100A (see FIG. 6). This grid could be produced from metal sheet or from metalized plastic material. Apertures in this sheet do not differ in shape and dimensions from the ones in the "normal" metal grids.

Figure 7:
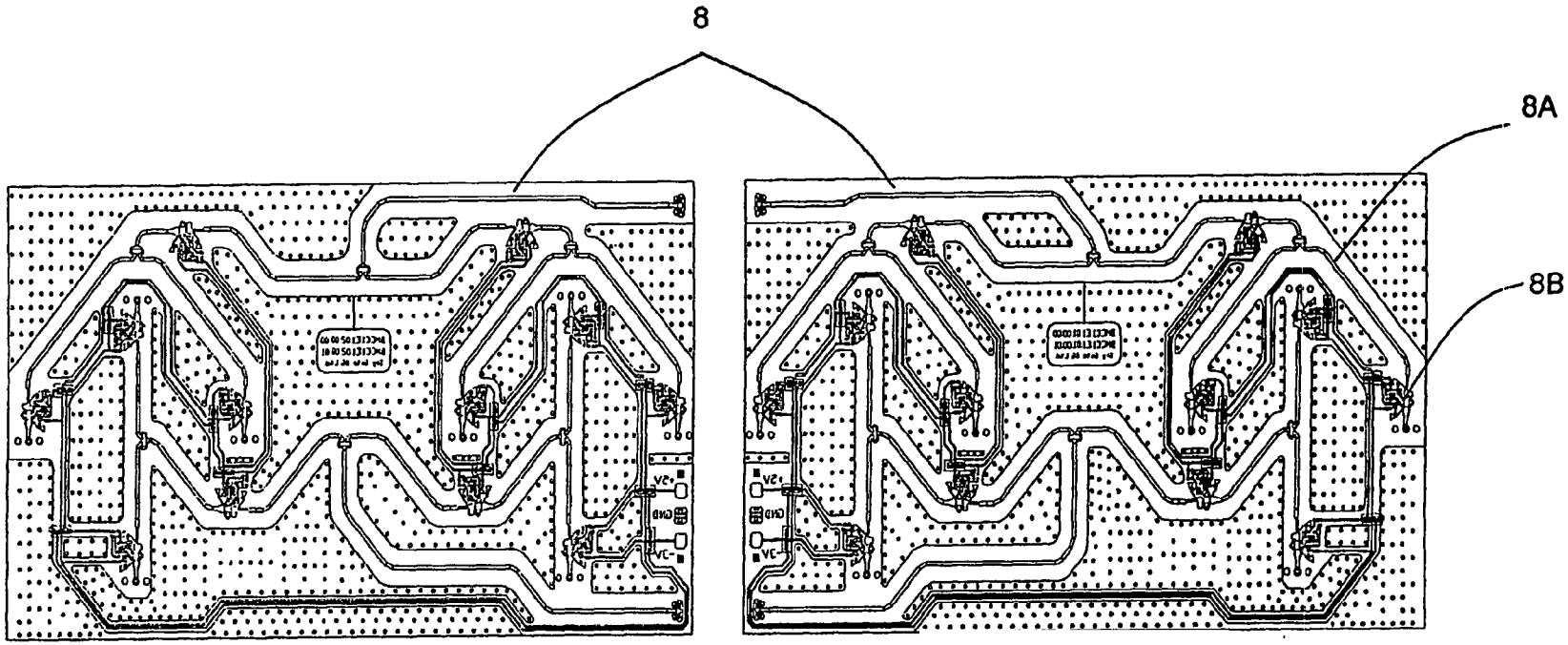
FIG. 7 illustrates the construction of the layer with active devices in accordance with an embodiment of the invention.

After the initial combining of the signals from radiating elements in each sub-array on the level of antenna layers 4 and 5, the obtained corporate signals are transferred to the inputs of the first stage of low noise amplifiers 8B, situated on the active layer 8 shown in FIG. 7. On this level the signals from different sub-arrays are amplified and combined to form the corresponding polarization signal from the two antenna halves. The active layer 8 comprises low noise microwave amplifiers 8B, passive microstrip combining devices, transmission lines 8A and circuits for DC supply, all of them accomplished using printed circuit board technology. The number of the active devices is defined by the antenna panel dimensions and by the number of sub-arrays. A low loss dielectric substrate is used to produce this layer in order to obtain good antenna gain-to-system noise ratio.

Figure 9:
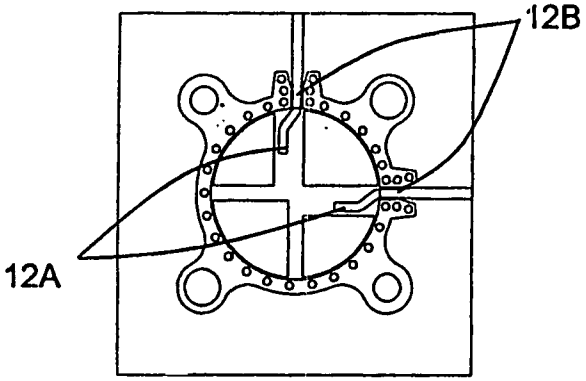
FIG. 9 is a top view of the transition between the microstrip line and the circular waveguide structures in accordance with an embodiment of the invention.
Figure 8:
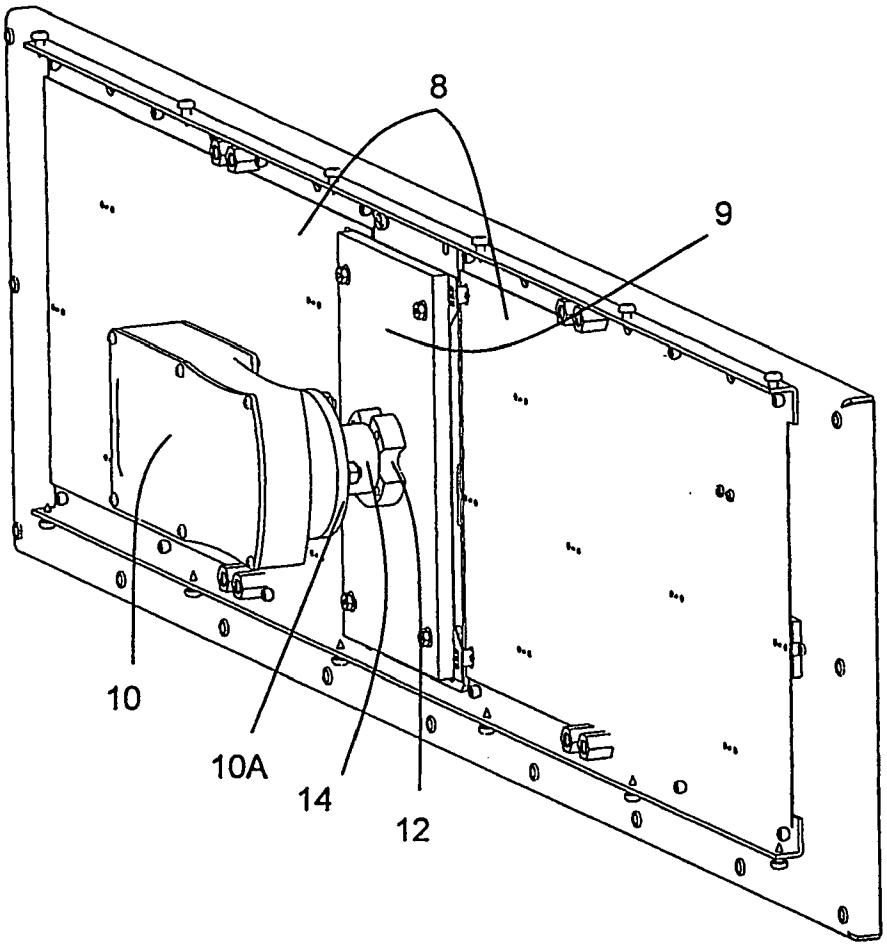
FIG. 8 is a 3D view of the transition between the antenna output and the twin low noise block input in accordance with an embodiment of the invention.

Amplified signals for both polarizations are combined independently for the antenna halves Ha1 and Ha2 (see FIG. 1) and after that are transferred to the polarization control block shown in FIG. 8. This block sums the signals from the antenna halves, controls the polarization, and provides required signals for the mobile antenna tracking system. By appropriate processing in this block (combining, phasing and amplitude control) any type of polarization could be obtained, namely linear (vertical and horizontal) and circular (left and right). Tracking information signals are provided after phasing and combining of the signals from both antenna halves Ha1 and Ha2. Output signals for the desired polarization and information signals for the tracking are selected by switching and are connected to the two inputs of the transition 12 between microstrip lines and cylindrical waveguide 14 shown in FIG. 8 and FIG. 9. This transition connects the antenna output to the input of a standard twin low noise block 10 and the coupling between them is accomplished by means of a standard waveguide flange 10A. The transition has a specific design in order to provide good decoupling (better than 20 dB in the frequency band 10.7-12.7 GHz) between the two inputs, which are on the same level. This is achieved by the special shape of the microstrip line ends 12A (see FIG. 9) used for excitation of the cylindrical waveguide 14 (see FIG. 8). In the areas where the microstrip line passes to the waveguide a short section of grounded coplanar line 12B is used to obtain better matching.

The invention claimed is:

1. An apparatus comprising a plurality of conductive layers, each conductive layer having a plurality of apertures, a plurality of antenna feed mechanism layers disposed between the conductive layers, each including a plurality of excitation probes about aligned with the apertures and arranged as subarrays with alternating polarizations, the subarrays of a first antenna feed mechanism layer of the plurality of antenna feed mechanism layers being juxtaposed with the subarrays of a second feed mechanism layer of the plurality of antenna feed mechanism layers with different polarizations, the apparatus further including an amplification circuit for amplifying received signals and a combining block for combining received signals, the received signals being coupled to a Low Noise Block (LNB).

2. The apparatus of claim 1, including insulating layers including a low-loss dielectric material disposed between the conductive layers and the antenna feed mechanism layers.

3. The apparatus of claim 1 comprising two antenna feed mechanism layers, each feed mechanism layer divided to eight subarrays, wherein pairs of subarrays are identical and each pair forms one quarter of the feed mechanism layer.

4. The apparatus of claim 3, wherein adjacent antenna quarters are rotated at 90° angle to each other.

5. The apparatus of claim 1, wherein the antenna feed mechanism layer includes a central conductor of a strip line and a metal sheet with a thickness of 0.1 to 0.3 mm, formed using thin metal sheet etching.

6. The apparatus of claim 5, wherein the metal sheet forms supporting frames and elements for mechanical connection.

7. The apparatus of claim 6, wherein the elements for mechanical connection are accomplished as RF decoupling circuits.

8. The apparatus of claim 7, wherein each of the apertures has an octagonal shape with two parallel long sides and two shorter parallel sides connecting each one of the corresponding ends of the long sides with the respective ends of each one of the shorter sides.

9. The apparatus of claim 1, wherein one of the conductive layers is thicker than the other conductive layers.

10. A method of configuring a satellite antenna comprising disposing a plurality of conductive layers having apertures proximate to a plurality of antenna feed mechanism layers, arranging the plurality of conductive layers and feed mechanism layers in alternating layers, configuring the antenna feed mechanism layers as a plurality of subarrays with different polarizations in a layer, juxtaposing the subarrays of a first antenna feed mechanism layer of the plurality of antenna feed mechanism layers with the subarrays of a second feed mechanism layer of the plurality of antenna feed mechanism layers having a different polarization.

11. The method of the configuring a satellite antenna of claim 10 comprising, configuring the antenna feed mechanism layers to have tapered elements.

* * * * *